US006448541B1

(12) United States Patent
Lim

(10) Patent No.: US 6,448,541 B1
(45) Date of Patent: Sep. 10, 2002

(54) AC/DC TYPE MICROWAVE OVEN

(75) Inventor: Dong-bin Lim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/831,313

(22) PCT Filed: Dec. 29, 1998

(86) PCT No.: PCT/KR98/00483

§ 371 (c)(1),
(2), (4) Date: May 8, 2001

(87) PCT Pub. No.: WO00/30407

PCT Pub. Date: May 25, 2000

(30) Foreign Application Priority Data

Nov. 13, 1998 (KR) ..... 98-48690

(51) Int. Cl.[7] ..... H05B 6/68
(52) U.S. Cl. ..... 219/702; 219/715
(58) Field of Search ..... 219/702, 715, 219/717, 722, 723, 746

(56) References Cited

U.S. PATENT DOCUMENTS 4,904,837 A 2/1990 Low
5,237,140 A * 8/1993 Akazawa et al. ..... 219/717
5,276,300 A * 1/1994 Low et al. ..... 219/717
5,331,128 A 7/1994 Koh
6,153,869 A * 11/2000 Kim et al. ..... 219/715
6,153,870 A * 11/2000 Kim et al. ..... 219/715

FOREIGN PATENT DOCUMENTS

DE 4143366 C2 6/1995

* cited by examiner

*Primary Examiner*—Teresa Walberg
*Assistant Examiner*—Quang Van
(74) *Attorney, Agent, or Firm*—Robert E. Bushnell, Esq.

(57) ABSTRACT

An AC/DC microwave oven includes a selecting switch selecting AC or DC input power; a supplier supplying power using a common driving load driven by the DC power, and supplying the AC input power or DC/AC converted power selected by the selecting switch; and a microwave oscillator driven by AC power supplied by the supplier. The AC/DC type microwave oven includes a rectifier rectifying the AC input power into DC power; driving load driven by rectified DC power or DC input power; rotatable inverter including a motor driven by the DC input power, and commutator producing AC power according to the DC input power inputted to one direction which is outputting in two directions by means of input/output brushes contacted with four directions of the commutator and rotated by a motor; and microwave oscillating part driven by the AC power converted by the rotatable inverter or the AC input power.

12 Claims, 4 Drawing Sheets

AC/DC TYPE MICROWAVE OVEN

BACKGROUND OF THE INVENTION

1. Field of the Invention

The present invention relates to a microwave oven, and more particularly to an AC/DC type microwave oven, which is capable of using an AC (alternating current) power or a DC (direct current) power selectively.

2. Description of the Background Art

The microwave oven is an appliance for heating/cooking food using a microwave. In the microwave oven, a high voltage transformer steps up a common power source 120/230V of the AC power to a high voltage of 2,000V, and a magnetron driven by the high voltage 2,000V produces a microwave having a predetermined frequency. The microwave oscillates molecules of water in food, and then food is heated/cooked by the generated heat.

FIG. 1 is a partial cutaway perspective view of a conventional microwave oven.

In FIG. 1, the reference numeral 1 is a cabinet, the reference numeral 2 is a cooking chamber, and the reference numeral 3 is a device chamber. The reference numeral 4 is a door, the reference numeral 5 is a tray, and the reference numeral 6 is a cover. The cabinet 1 is partitioned into left and right spaces. At one side of the cabinet I is provided the cooking chamber 2 of which front is open. At the other side of the cabinet 2 is provided the device chamber 3 in which a variety of electrical devices are installed.

At the upper and side of the cabinet I is provided the cover 6 that forms the appearance of the microwave oven. The door 4 is fixed to one side of the cabinet I which is capable of pivoting so that the front of the cooking chamber 2 can be opened/closed thereby. The tray 5 is installed at the bottom of the cooking chamber 2, and food to be cooked is loaded on the tray 5. The tray 5 is rotated by a driving motor(not shown) installed at the lower side thereof.

The reference numeral 7 designates a control panel. The reference numeral 8 designates an air guide, and the reference numeral 9 designates a cooling fan. HVT, HVC, HVD and MGT designate a high voltage transformer, a high voltage condenser, a high voltage diode and a magnetron, respectively. They are installed in the device chamber 3, and are connected electrically with each other. The high voltage transformer HVT transforms a common alternating current AC into a high voltage, and the high voltage is doubled by the high voltage condenser HVC and the high voltage diode HVD (which is 4,000V approximately). Then, the doubled high voltage is applied to the magnetron MGT, and then a 2,450 MHz (megahertz) microwave is generated by the magnetron MGT.

The control panel 7 is installed at the front side of the device chamber 3, through which a user operates the microwave oven, and the operational state of the microwave oven is displayed.

The cooling fan 9 cools the magnetron MGT and the high voltage transformer HVT by blowing forced air. The air guide 8 is installed near the magnetron MGT so that the air heated during the cooling operation of the magnetron MGT is guided into the cooking chamber 2.

FIG. 2 is a block diagram of AC/DC type microwave oven according to the prior art, and FIG. 3 is a schematic diagram of FIG. 2.

In FIG. 2, AC/DC type microwave oven according to the prior art includes an AC driving load 10, a DC driving load and DC/AC converting part 20, and a microwave oscillator 30.

The AC driving load 10 is driven by an AC input power. The DC driving load and DC/AC converting part 20 include the DC driving load being driven by a DC input power and the DC/AC converter converting the DC input power into an AC power. The microwave oscillator 30 is inputted by the power out of the AC input power or the DC/AC power converted by a DC/AC converter, and generates a 2,450 MHz (megahertz) microwave.

With reference to FIG. 3, a schematic diagram of AC/DC type microwave oven is described as follows.

In FIG. 3, the AC input power is connected to the AC driving loads 11, and is connected to a power switch $SW_1$ to determine the driving status of the AC power. The AC driving loads 11 include a lamp 12*a* and a cooling fan motor 12*b* being operated by an AC power. The DC power is connected to the DC driving loads 21, and is connected to a power switch $SW_2$ to determine the driving status of the DC power, and forms a differential DC circuit net discriminated as an AC circuit net. The DC driving loads include a lamp 22*a* and a cooling fan motor 22*b* being operated by a DC power.

The DC input power is connected to the DC/AC converter 23. The microwave oscillating part 30 includes a high voltage transformer HVT which receives both the AC power and the DC power, a high voltage condenser HVC, a high voltage diode HVD, and a magnetron MGT. The operation of the microwave oscillator is described the same way as shown in FIG. 1.

The operation of a conventional microwave oven having the above-described constitution is as follows. First, the user pulls the door 4 so that cooking chamber 2 is opened, then places a container containing food on the tray 5. The user closes the door 4, switches-on the power switch $SW_1$ or the power switch $SW_2$ selectively, and then operates the microwave oven. The user, however, must switch on only one of the DC power switch $SW_2$ or the AC power switch $SW_1$ according to the input power described. For example, in case the user switches on the AC power switch $SW_1$, the AC input power supplies to the driving load that includes the lamp 12*a* and the cooling fan motor 12*b*. The AC input power also supplies to the high voltage transformer HVT of the microwave oscillating part 30. When the AC power supplied to the high voltage transformer HVT is converted to a high voltage through the high voltage condenser HVC and the high voltage diode HVD, the high voltage is supplied to the magnetron MGT. The magnetron MGT driven by the high voltage generates a microwave. The generated microwave radiates it into the cooking chamber 2 for the heating/cooking of food, and then radiates it into food uniformly when the tray 5 is rotated in the cooking chamber 2. In the device chamber 3, the cooling fan 9 cools the inner devices by blowing air. The tray 5 rotates the food in order to radiate the microwave on the food uniformly. Therefore, the food in the cooking chamber 2 is heated/cooked properly according to the cooking time and cooking temperature that have been selected by the user.

In case the user switches on the DC power switch $SW_2$, a DC input power supplies to the driving load that includes the lamp 22*a* and the cooling fan motor 22*b*, and supplies to the DC/AC converting part 23. The DC/AC converting part 23 converts the DC input power into an AC power, and then the converter AC power supplies to the high voltage transformer HVT of the microwave oscillating part 30. After the converted AC power supplied to the high voltage transformer HVT is converted to a high voltage by the high voltage condenser HVC and the high voltage diode HVD, the high voltage is supplied to the magnetron MGT. The magnetron MGT driven by the high voltage generates a microwave. The generated microwave radiates it into the cooking chamber 2 for the heating/cooking of food.

In such a conventional AC/DC type microwave oven, the microwave oven must be provided with the differentiated driving loads for AC and DC, respectively. As the number of parts of the microwave increases, the manufacturing cost of the microwave oven increases.

Furthermore, in case the AC power and the DC power are selected by the user the same time mistakenly, a conventional microwave oven increases the possibility of faulty operations since a conventional microwave oven cannot prevent such an occurrence.

SUMMARY OF THE INVENTION

The present invention has been made to overcome the above described problem of the prior art, and accordingly it is the first object of the present invention to provide an AC/DC type microwave oven for reducing the manufacturing cost of the microwave oven by reducing the number of parts of the driving loads that include a lamp and a cooling fan motor driven by the AC power.

It is the second object of the present invention to provide an AC/DC type microwave oven to prevent the faulty operations of the microwave oven by limiting the selection of only one of the AC power and the DC power available.

To achieve the above objectives, the present invention provides an AC/DC type microwave oven comprising: means for selecting an AC input power or a DC input power; means for supplying power using a common driving load being driven by the DC power, and supplying the AC input power or a DC/AC converted power selected by the means for selecting; and means for oscillating the microwave being driven by the AC power supplied by the means for suppling power.

The means for selecting comprises: one more exchanging switch for supplying a circuit net with only one of the AC input power or the DC input power available, when the AC input power and the DC input power form an AC circuit net and a DC circuit net, respectively, which are discriminated from each other.

The one more exchanging switch includes: a first exchanging switch being connected to a common line of the AC and DC circuit nets; a second exchanging switch being connected to the AC circuit net; and a third exchanging switch being connected to the DC circuit net.

The means for supplying power includes: a rectifying part for rectifying the AC input power into a DC power; driving load being driven by the rectified DC power or the DC input power; and DC/AC converting part for converting the DC input power into AC power.

The rectifying part includes: a low voltage transformer to step-down the AC input power; and a bridge diode for rectifying the step-down AC input power into DC power.

The DC/AC converting part is a rotatable inverter for producing an AC power according as the DC power inputted in one direction is outputted in turn in two directions. The rotatable inverter includes: a motor being driven by the DC input power; and a commutator for producing an AC power according to the DC input power being inputted in one direction is outputting in turn in two directions by means of input/output brushes being contacted with four directions of the commutator and being rotated by the motor.

To achieve the above objectives, the present invention provides an AC/DC type microwave oven including: means for rectifying the AC input power into a DC power; a driving load being driven by a rectified DC power or the DC input power; a rotatable inverter including a motor being driven by the DC input power, and a commutator for producing an AC power according to the DC input power being inputted in one direction is outputting in turn in two directions by means of input/output brushes being contacted with four directions of the commutator and being rotated by the motor; and a microwave oscillating part for being driven by the AC input power or the AC power converted by the rotatable inverter.

The means for rectifying includes: a low voltage transformer to step-down the AC input power; and a bridge diode for rectifying the step-down AC input power into DC power.

The means for selecting includes: one more exchanging switch for supplying a circuit net with only one of the AC input power or the DC input power, when the AC input power and the DC input power form an AC circuit net and a DC circuit net, respectively which are discriminated from each other.

The one more exchanging switch includes: a first exchanging switch being connected to a common line of the AC and DC circuit nets; a second exchanging switch being connected to the AC circuit net; and a third exchanging switch being connected to the DC circuit net.

Accordingly, an AC/DC type microwave oven adopts the only driving load driven by the DC power, reduces the number of parts of the AC driving load that include a lamp and a cooling fan motor driven by the AC power, and reduces the manufacturing cost of the microwave oven. Besides, the AC/DC type microwave oven can prevent the faulty operation by means of entering selectively only one of the AC power or the DC power.

BRIEF DESCRIPTION OF THE DRAWINGS

The above object and other advantages of the present invention will become more apparent by describing in detail in a preferred embodiment thereof with reference to the attached drawings, in which.

DETAILED DESCRIPTION OF THE PREFERRED EMBODIMENTS

The present invention will become more apparent by describing in detail in a preferred embodiment thereof with reference to the attached drawings.

Figure 4:
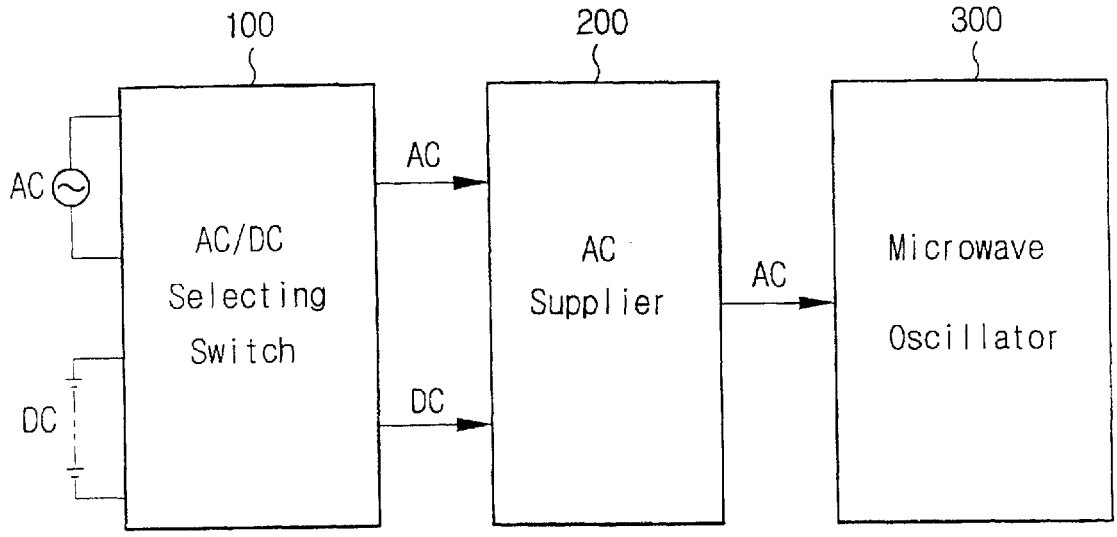
FIG. 4 is a block diagram of AC/DC type microwave oven according to the present invention.
Figure 5:
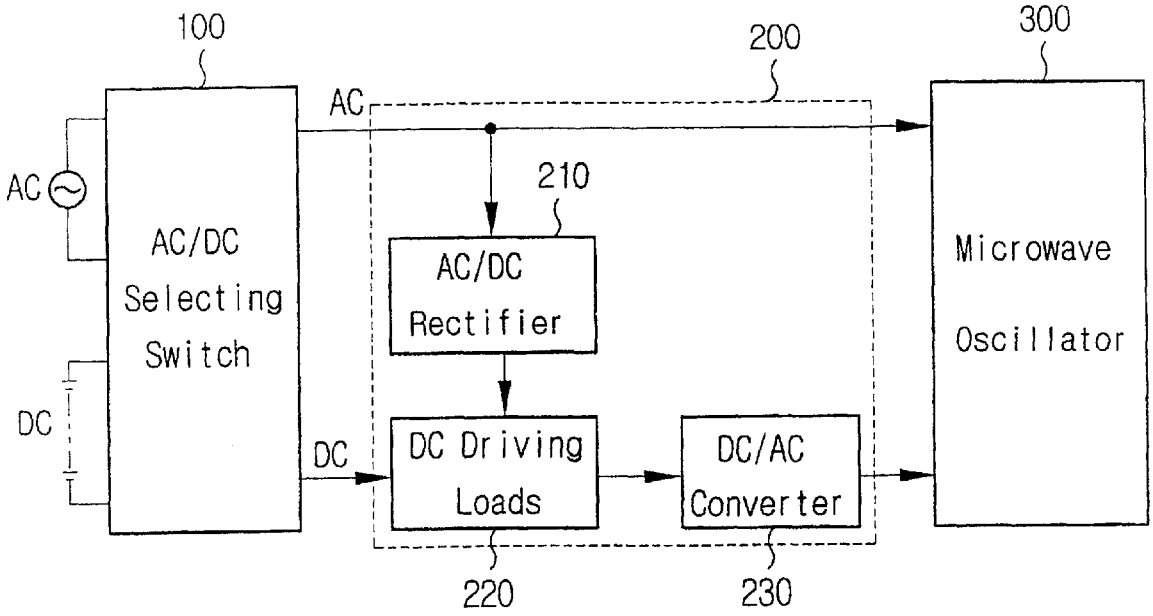
FIG. 5 is a detailed block diagram of AC/DC type microwave oven according to the present invention.

FIG. 4 and FIG. 5 are a block diagram and a detailed block diagram, respectively, according to the present invention. In FIG. 4, an AC/DC type microwave oven includes: an AC/DC selecting switch 100 for selecting an AC input power or a DC input power; an AC supplier 200 for using a common driving load being driven by a DC power, and for supplying the AC input power or a converted AC power selected by the AC/DC selecting switch 100; and a microwave oscillator 300 for generating microwave according to being driven by the AC power in the AC supplier 200.

FIG. 5 is a detailed schematic diagram of the AC supplier 200 in FIG. 4, and the AC supplier 200 includes: AC/DC rectifier 210 for rectifying the AC input power into a DC power; DC driving loads 220 being driven by the rectified DC power or the DC input power; and DC/AC converter 230 for converting the DC input power into AC power.

In the AC/DC type microwave oven according to the present invention, the user selects one of the AC input power or the DC input power. If the selected power is the AC input power, the AC/DC rectifier 210 rectify the AC input power into the DC power. The rectified DC power drives the DC driving loads 220, and the AC input power is supplied to the microwave oscillator 300. If the selected power is the DC input power, the DC input power drives the DC driving loads 220, and then the AC input power is supplied to the microwave oscillator 300. The DC/AC converter 230 that is a rotatable inverter converts the DC input power into DC power, and then supplies to the microwave oscillator 300. Thus, the DC driving load 220 that includes a lamp or a cooling fan motor is driven only by the DC power.

Figure 6:
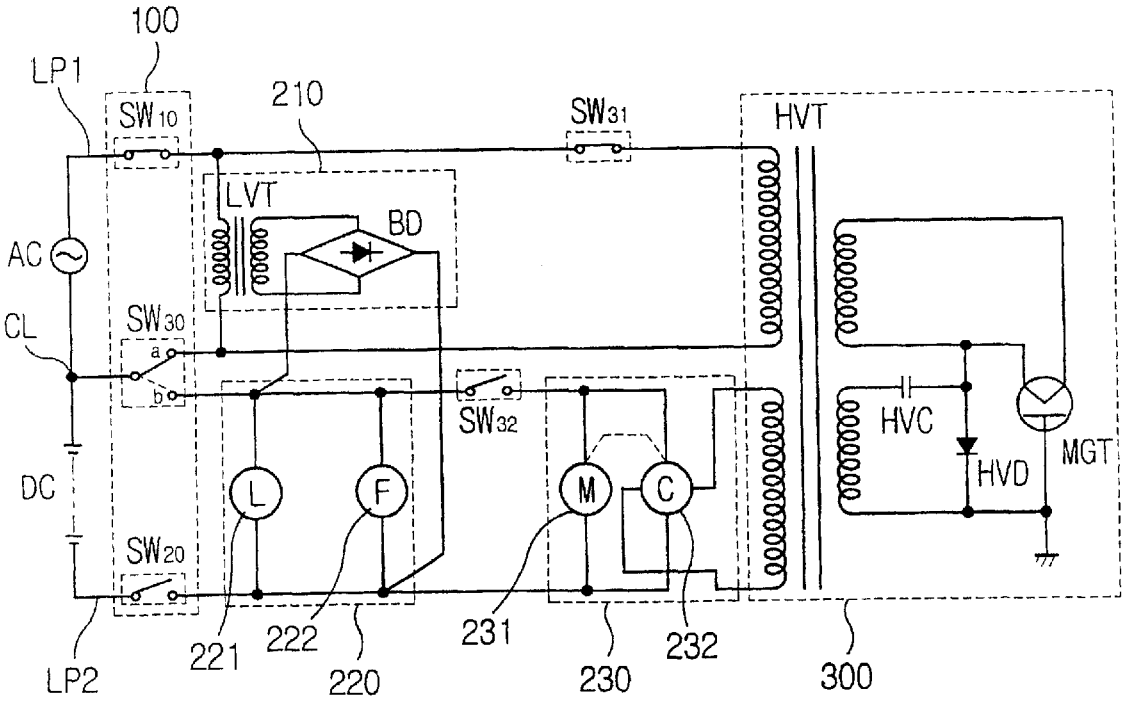
FIG. 6 is a schematic diagram of AC/DC type microwave oven being driven by an AC power according to the present invention.
Figure 7:
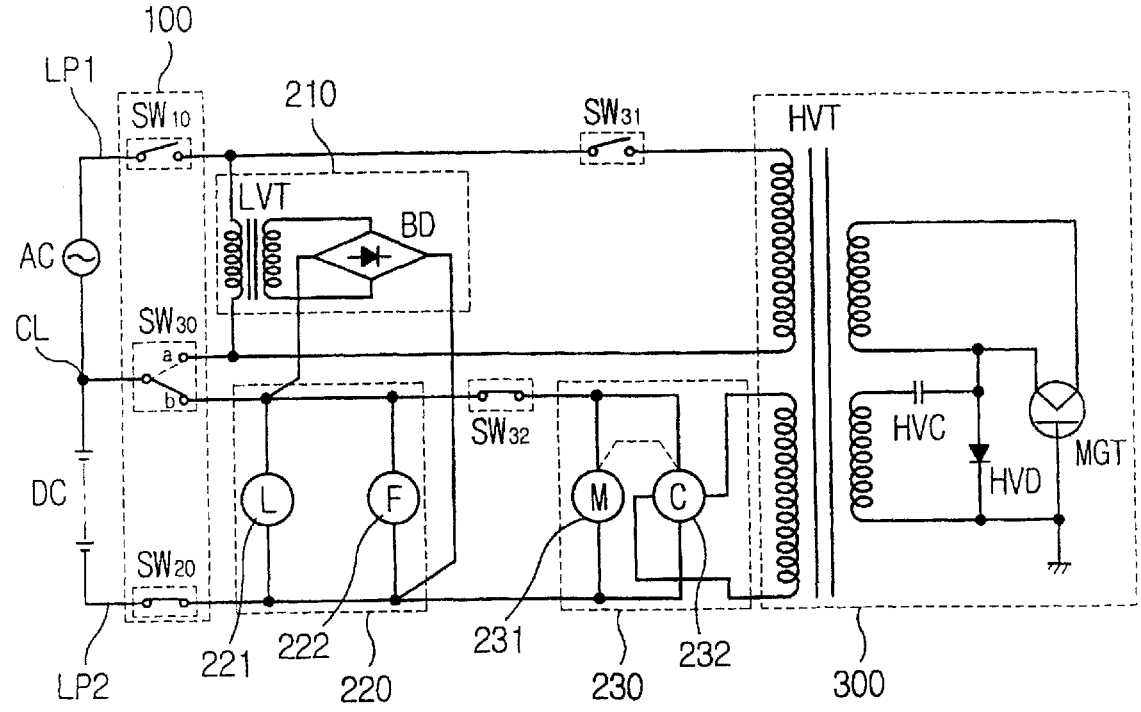
FIG. 7 is a schematic diagram of AC/DC type microwave oven being driven by a DC power according to the present invention.

FIG. 6 and FIG. 7 are schematic diagrams of the AC/DC type microwave oven according to the present invention. FIG. 6 shows the driving status of the AC power, and FIG. 7 shows the driving status of the DC power.

In FIGS. 6 and 7, the reference numeral 220 is a DC driving load, the reference numeral 221 is a lamp, the reference numeral 222 is a cooling fan motor. The reference numeral 210 is an AC/DC rectifier, the reference numeral 230 is a rotatable inverter, and the reference numeral 300 is a microwave oscillator. $SW_{10}$ and $SW_{20}$ are power switches. $SW_{30}$, $SW_{31}$, and $SW_{32}$ are exchanging switches. LVT, HVT, MGT, BD, LP1, LP2 and CL designate a low voltage transformer, a high voltage transformer, a magnetron, a bridge diode, an AC circuit net, a DC circuit net, and a common line of the AC and DC, respectively. The AC/DC rectifier 210 includes the low voltage transformer LVT to step-down the AC input power, and the bridge diode BD for rectifying the step-down AC power by the low voltage transformer LVT into a DC power. Also, the DC/AC converter 230 is a rotatable inverter that outputs an AC power in turn in two directions according to the DC input power inputted in one direction. The rotatable inverter 230 includes a motor 231 being driven by the DC input power; and a commutator 232 for producing an AC power according to the DC input power being inputted in one direction is outputed in turn in two directions by means of input/output brushes being contacted with four directions of the commutator 232 and being rotated by the motor 231.

Selecting switch 100 includes one more exchanging switch for supplying a circuit net with only one of the AC input power or the DC input power able to be used at one time, when the AC input power and the DC input power form an AC circuit net LP1 and a DC circuit net LP2, respectively, which are discriminated from each other. One more exchanging switch includes a first exchanging switch $SW_{30}$ being connected to a common line CL of the AC and DC circuit nets; a second exchanging switch $SW_{10}$ being connected to the AC circuit net LP1; and a third exchanging switch $SW_{20}$ being connected to the DC circuit net LP2.

As shown in FIGS. 6 and 7, the AC input power and the DC input power form circuit nets of the AC and DC, respectively, which are discriminated from each other. The circuit nets is provided the power switches $SW_{10}$, $SW_{20}$ for switching on/off the respective power. The AC/DC rectifier 210 being formed in the AC circuit net LP1 rectifies the AC input power into the DC power. The AC/DC rectifier 210 includes the low voltage transformer LVT to step-down the AC input power into the DC power, and the bridge diode BD for rectifying the step-down AC power into the DC power. The DC driving load 220 comprises the lamp L and the cooling fan motor F driven by the rectified DC power. The rotatable inverter 230 includes a motor 231 being driven by the DC input power, and the commutator 232 for producing AC power according to the DC input power inputted in one direction which is in turn outputted in two directions by means of input/output brushes (not shown) being contacted with four directions of the commutator 232 and being rotated by the motor 231. Also, the microwave oscillator 300 is driven by the AC input power and the DC/AC converted power. The microwave oscillator 300 includes the high voltage transformer HVT, the high voltage condenser HVC, the high voltage diode HVD, and the magnetron MGT. The operation of the microwave oscillator 300 was described in the prior art.

Also, for inputting selectively only one power of the AC input power or the DC input power, selecting switches 100 include the exchanging switches $SW_{30}$, $SW_{31}$, $SW_{32}$. The first exchanging switch $SW_{30}$ is connected to the common line of the circuit nets, the second exchanging switch $SW_{31}$ is connected to the AC circuit net LP1, and the third exchanging switch $SW_{32}$ is connected to the DC circuit net LP2.

In the structure of the above-mentioned, the driving status of the AC power is described as follows with reference to FIG. 6.

The user selects a power for use according to the selection of the first exchanging switch $SW_{30}$. That is, in case the user wants to use the AC power, the AC power is supplied to the microwave oven by means of switching the first exchanging switch $SW_{30}$ connected to the common line CL into terminal a located in the AC circuit net LP1. Therefore, the second exchanging switch $SW_{31}$ in the AC circuit net LP1 is switched on, and the third exchanging switch $SW_{32}$ is switched off as shown in FIG. 6. It is preferable that the second and third exchanging switches $SW_{31}$, $SW_{32}$ operate exclusively when one switch is switched-on or when another switch is switched-off The user pulls the door 4 to open the cooking chamber 2, and then places a container containing food on the tray 5. Next, the user closes the door 4, then switches on the power switch $SW_{10}$, which operates the microwave oven. In the AC circuit net LP1 formed a closed loop, the AC input power is supplied to the low voltage transformer LVT within the AC/DC rectifier 210, which is supplied to the high voltage transformer HVT within the microwave oscillator 300. The low voltage transformer LVT steps down the AC input power, and the bridge diode BD rectifies the step-down AC power into the DC power. Then, the rectified DC power is supplied to the DC driving load 220 in the DC circuit net LP2 so as to drive the lamp L and the cooling fan motor F. When the AC power being supplied to the high voltage transformer HVT in the microwave oscillator 300 is converted into the high voltage through the high voltage condenser HVC and the high voltage diode HVD, the converted AC power is supplied to the magnetron MGT. The magnetron MGT driven by the high voltage generates the microwave so as to radiate into the cooking chamber 2 for heating/cooking food.

Since the DC circuit net LP2 forms an open loop, the rotatable inverter 230 connected to the DC circuit net LP2 cannot operate even though the DC power switch $SW_{20}$ is switched on according to the selection status of the AC power by means of the exchanging switches $SW_{30}$, $SW_{31}$, $SW_{32}$. Therefore, the microwave oven has no possibility of faulty operation.

Figure 1:
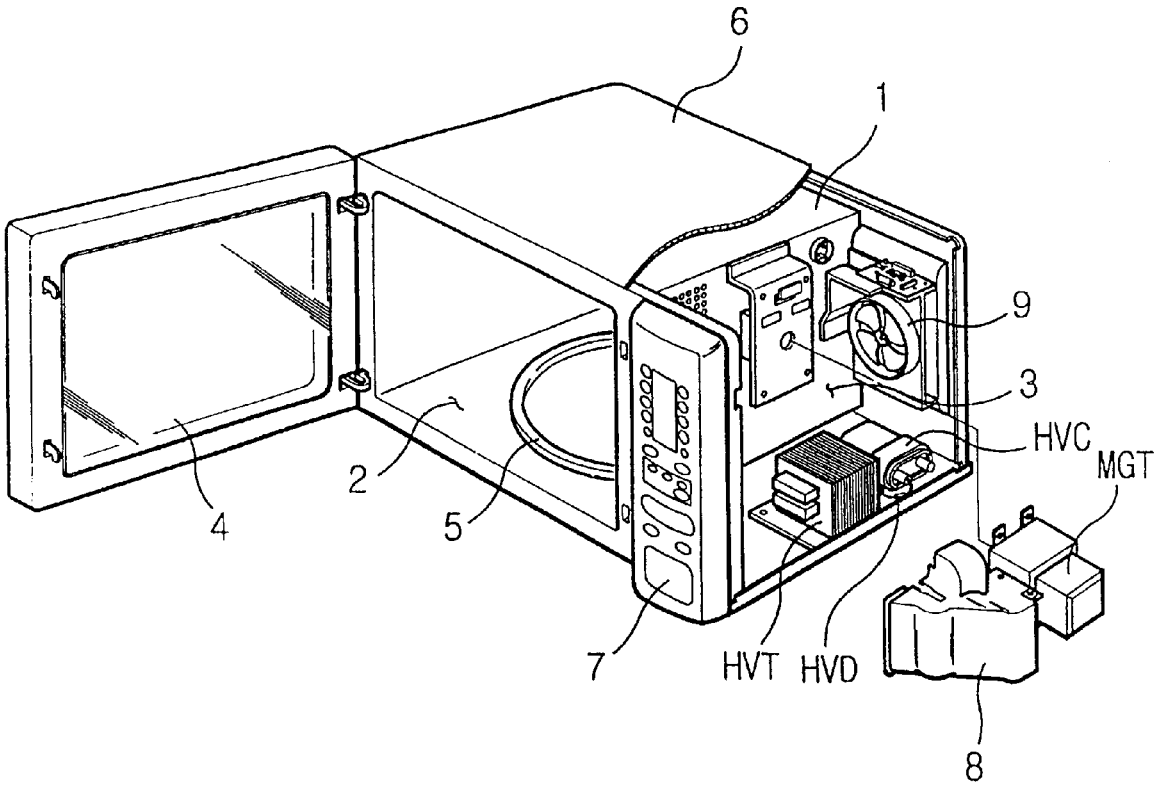
FIG. 1 (Prior Art)
FIG. 1 is a partial cutaway view of a conventional microwave oven.
Figure 2:
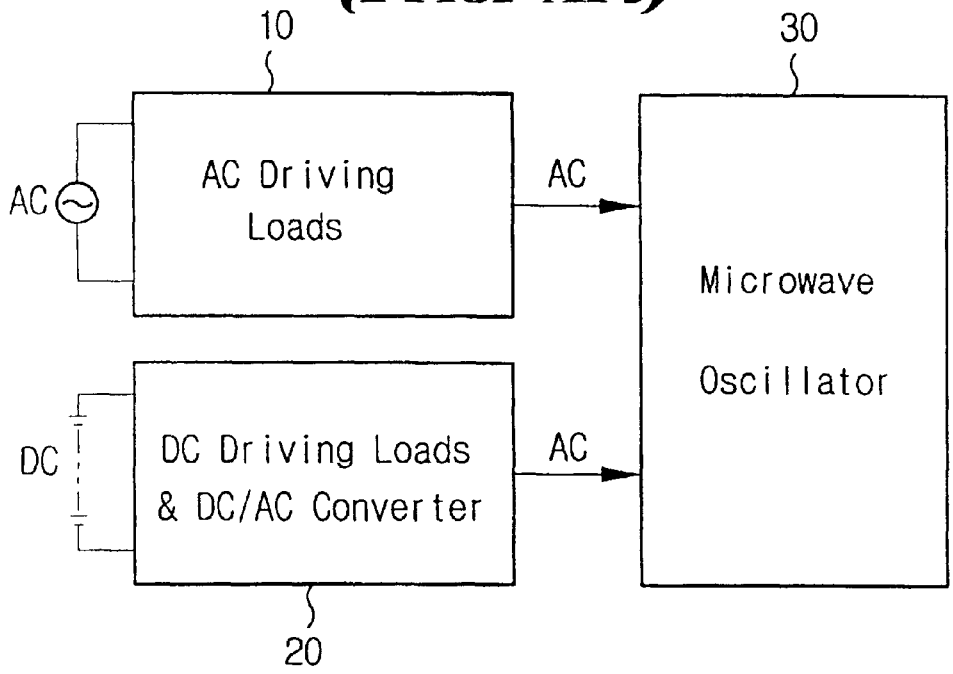
FIG.2 (Prior Art)
FIG. 2 is a block diagram of AC/DC type microwave oven according to the prior art.
Figure 3:
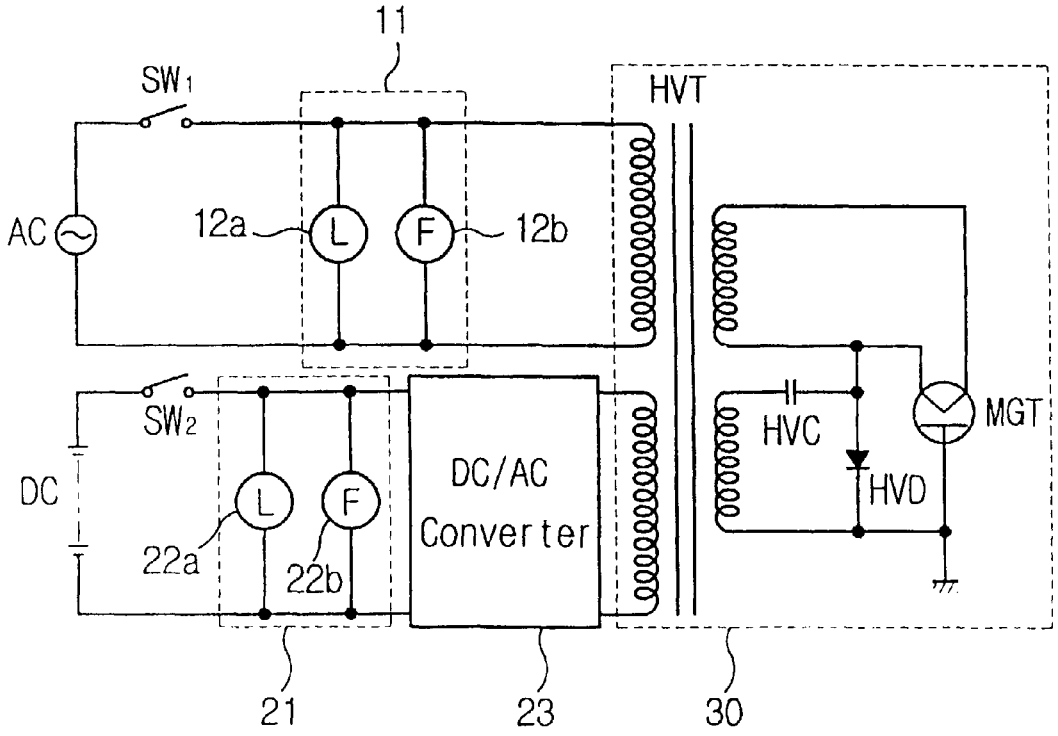
FIG.3 (Prior Art)
FIG. 3 is a schematic diagram of FIG. 2.

The driving status according to the DC power is described as follows with reference to FIG. 7. The user enters the DC power into microwave oven by means of switching the first exchanging switch $SW_{30}$ connected to the common line CL into terminal b located in the DC circuit net LP2. Therefore, the second exchanging switch $SW_3$, in the AC circuit net LP1 is switched off, and the third exchanging switch $SW_{32}$ is switched on as shown in FIG. 7. As shown be FIG. 1, the user pulls the door 4 to open the cooking chamber 2, and then places a container containing food on the tray 5. The user closes the door 4, then switches on the power switch $SW_{20}$, which operates the microwave oven. In the DC circuit net LP2 is formed a closed loop, the DC input power is supplied to the DC driving load 220 in the DC circuit net LP2 so as to drive the lamp L and the cooling fan motor F. The DC input power is supplied to the rotatable inverter 230, and then the motor 231 driven by the DC power rotates the commutator 232 being inputted to one direction by means of input/output brushes (not shown) being contacted with four directions of the commutator 232. The DC power converts into the AC power by means of the rotation of the commutator 232. The AC power being supplied to the high voltage transformer HVT within the microwave oscillator 300 is converted into the high voltage through the high voltage condenser HVC and the high voltage diode HVD. The converted AC power is supplied to the magnetron MGT. The magnetron MGT being driven by the high voltage generates the microwave to radiates into the cooking chamber 2 for heating/cooking food. Since the AC circuit net LP1 forms an open loop, the rotatable inverter 230 connected to the DC circuit net LP2 cannot operate even though the AC power switch $SW_{10}$ is switched on according to the selection status of the DC power by means of the exchanging switches $SW_{30}$, $SW_{31}$, $SW_{32}$. Therefore, the microwave oven has no the possibility of faulty operation.

In the AC/DC type microwave oven according to the above-mentioned invention, since the AC/DC type microwave oven adopts only DC driving load being driven by the DC power, the manufacturing cost reduces due to reduced number of parts of the AC driving load. Besides, the microwave oven is prevented from the faulty operation by means of selecting one of the AC power or the DC power operations.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. An AC/DC type microwave oven comprising:

means for selecting an AC input power or a DC input power;

means for supplying power using a common driving load being driven by a DC power, and supplying said AC input power or a DC/AC converted power being selected by said means for selecting; and means for oscillating microwave being driven by said AC power supplied by said means for supplying power.

2. The AC/DC type microwave oven as claimed in claim 1, wherein said means for selecting comprises one more exchanging switch for supplying each circuit net with only one of said AC input power or said DC input power, when said AC input power and said DC input power form an AC circuit net and a DC circuit net, respectively, which are discriminated from each other.

3. The AC/DC type microwave oven as claimed in claim 2, wherein said one more exchanging switch comprises:

a first exchanging switch being connected to a common line of said AC and DC circuit nets;

a second exchanging switch being connected to said AC circuit net; and a third exchanging switch being connected to said DC circuit net.

4. The AC/DC type microwave oven as claimed in claim 1, wherein said means for supplying power comprises:

a rectifying part for rectifying said AC input power into a DC power;

a driving load for being driven by said rectified DC power or said DC input power; and a DC/AC converting part for converting said DC input power into an AC power.

5. The AC/DC type microwave oven as claimed in claim 4, wherein said rectifying part comprises:

a low voltage transformer to step-down said AC input power; and a bridge diode for rectifying said step-down AC input power into the DC power.

6. The AC/DC type microwave oven as claimed in claim 4, wherein said DC/AC converting part is a rotatable inverter for producing an AC power according as a DC power being inputted to one direction which is outputting in turn in two directions.

7. The AC/DC type microwave oven as claimed in claim 6, wherein said rotatable inverter comprises:

a motor being driven by said DC input power; and a commutator for producing AC power according as said DC input power being inputted to one direction is outputting in turn in two directions by means of input/output brushes being contacted with four directions of said commutator and being rotated by said motor.

8. The AC/DC type microwave oven as claimed in claim 1, wherein said driving load is a lamp or a cooling fan motor being driven by said DC power.

9. An AC/DC type microwave oven comprising:

means for rectifying an AC input power into a DC power;

a driving load being driven by said rectified DC power or a DC input power;

a rotatable inverter including a motor being driven by said DC input power, and a commutator for producing AC power according as said DC input power being inputted to one direction which is outputting in turn in two directions by means of input/output brushes being contacted with four directions of said commutator and being rotated by said motor; and a microwave oscillating part being driven by said AC power converted by said rotatable inverter or said AC input power.

10. The AC/DC type microwave oven as claimed in claim 9, wherein said means for rectifying comprises:

a low voltage transformer to step-down said AC input power; and a bridge diode for rectifying said step-down AC input power into a DC power.

11. The AC/DC type microwave oven as claimed in claim 9, wherein said means for selecting comprises one more exchanging switch for supplying each circuit net with only one of said AC input power or said DC input power, when said AC input power and said DC input power form an AC circuit net and a DC circuit net, respectively, which are discriminated from each other.

12. The AC/DC type microwave oven as claimed in claim 11, wherein said one more exchanging switch comprises:

a first exchanging switch being connected to a common line of said AC and DC circuit nets;

a second exchanging switch being connected to said AC circuit net; and a third exchanging switch being connected to said DC circuit net.

* * * * *